United States Patent [19]

Gates

[11] 4,426,801

[45] Jan. 24, 1984

[54] COLLAPSIBLE DISPLAY SIGN ASSEMBLY

[76] Inventor: Frank M. Gates, Rte. 5, Box 2250, Ellensburg, Wash. 98926

[21] Appl. No.: 418,759

[22] Filed: Sep. 16, 1982

[51] Int. Cl.[3] ..... G09F 15/00

[52] U.S. Cl. ..... 40/606

[58] Field of Search ..... 40/107, 612, 606, 610; 116/63 P; 24/3 K

[56] References Cited

U.S. PATENT DOCUMENTS

| | | | |
|---|---|---|---|
| 600,344 | 3/1898 | Frost | 40/107 |
| 3,800,735 | 4/1974 | Simpson | 116/63 P |
| 3,929,266 | 12/1975 | Kim | 24/3 K |
| 3,933,119 | 1/1976 | Hedgewick | 116/63 P |
| 4,085,762 | 4/1978 | O'Brien | 116/63 P |
| 4,256,050 | 3/1981 | Barnard | 116/63 P |

*Primary Examiner*—Robert Peshock

*Attorney, Agent, or Firm*—John O. Graybeal

[57] ABSTRACT

A display sign assembly for temporary vehicular traffic control and the like, having a triangular base member with three triangular side panels each articularly joined as by relatively large snap rings to a respective side of the base member and each preferably bearing a different symbol or message display, the assembly being arrangeable with the side panels on either side of the base member in essentially fixed pyramid-like configurations for selected symbol or message display or in a stacked parallel manner with respect to the base member for ease of transport and storage.

7 Claims, 5 Drawing Figures

COLLAPSIBLE DISPLAY SIGN ASSEMBLY

DESCRIPTION

1. Field of the Invention

The present invention relates to collapsible display sign assemblies and more particularly to traffic warning or directing devices and the like.

2. Background Art

Two very desirable qualities for display sign assemblies such as traffic warning devices for temporary traffic control are lightweight compactness for easy storage and transport, and stability when erected.

Compactness of temporary traffic signaling devices has in the past been accomplished by making such devices of a folding, basically two dimensional frame construction. Hedgewick et al U.S. Pat. No. 3,933,119 depicts an example of this. The Hedgewick et al patent shows a triangular shaped signaling device wherein when the two legs are opened out, and combined with the base length, they form a triangle. The two legs can be folded down into the base length for compact storage. Although this open frame construction makes the sign/signaling device very compact and lightweight for easy storage and transport, because of its light weight, it is somewhat unstable.

One solution to this instability is presented in the Simpson U.S. Pat. No. 3,800,735. Depicted in this patent is an open frame tetrahedron wherein the frame itself is hollow. Through a filling valve conveniently placed in the frame, solids, liquids or gases can be introduced to fill the frame. By this means it is possible to introduce a particulate solid, such as gravel, partially filling the bottom of the frame, leaving the top of the frame to be filled with air or the like, thereby creating a low center of gravity and hence stability.

A second type of collapsible traffic warning device is depicted in the Barnard U.S. Pat. No. 4,256,050. This patent shows a resilient coil fixed to a base which can be extended to form a conical shape or collapsed into itself for storage purposes. Although this marker cone has closed sides when it is in its extended form, the sides are circular and thus it is difficult to print any messages or signs thereon.

SUMMARY OF THE INVENTION

It is the principal object of this invention to provide a lightweight collapsible sign system which comprises a large number of flat surfaces on which signs or message displays can appear, while being stable and able to remain upright even in strong wind gusts.

A further object is to provide a device which is both mechanically simple and inexpensive to manufacture. The system of hinging the side panels to the base by large openable rings not only allows the side panels to travel in an arc of basically 360° to the base, but allows side panels to readily be exchanged and/or replaced.

Another object of this invention is to provide a sign display assembly which is both lightweight and can readily be stabilized. The substantially closed side configuration of this sign system when erected allows it to be stabilized on the site of use merely by placing a large rock on top of the base and folding the sides up around it securing their apexes together. This feature allows the sign system itself to be built of nearly any rigid lightweight material such as fiberboard, metal panels, or sheets of plastic.

A further object of this invention is to present a sign display assembly designed such that, although it contains several messages, when placed facing traffic, only one discrete message is visible to oncoming traffic.

The present invention relates to a free-standing, lightweight portable sign display assembly which collapses to an essentially flat configuration for easy storage and transport, yet can be quickly and easily erected to display any one of several messages or signs. The sign display assembly comprises a substantially equilateral triangular base, each side of which is articularly joined to a substantially isosceles triangular shape side panel.

The isosceles triangular side panels are connected to the equilateral triangular base piece such that the base side of each isosceles triangular side panel is disposed next to a side of the equilateral triangular base piece.

The articular joinder of the side panels to the base is such that isosceles triangular side panel, relative to the equilateral triangular base member, can travel in an arc of substantially 360°. Further, this joinder means may be such that it allows for the ready detachment of any given side panel and the substitution of a different side panel therefor.

In a first assembly arrangement, all three side pieces are rotated relative to the base such that the apexes of the side panels meet in the center above the base, forming a pyramid-like tetrahedron. In said first assembly arrangement, a first side of each triangular side panel faces outward and is exposed to view, while the second side of each of the triangular side panels face inwardly toward the other side pieces and is hidden from view.

The second assembly arrangement is the inverted isomer of the first assembly arrangement. In the second assembly arrangement, the three triangular side panels are rotated relative to the base such that their apexes meet in the center above the base, forming a pyramid-like tetrahedron, but in the second assembly arrangement, the aforesaid second of each side panel faces outwardly and is exposed to view while the aforesaid first side thereof faces inwardly toward the other side panel faces concealed from view.

Because the side panels are inevitable relative to the base, which results in the inversion of the base as well, the sign display assembly has the capacity for displaying up to $2(N+1)$ or $2(N+2)$ separate surfaces or faces on which symbols or messages can be displayed, N being the number of sides of the regular convex polygon base. Since the base is an equilateral triangle, N equals 3 and the number of faces is $(2\times3)+2$, or 8. In the first and second assembly arrangements described above, the sign system is self-supporting, standing up by itself, with $N+1$ externally facing surfaces. Since the base is an equilateral triangle, N equal 3 and each display configuration offers $N+1$, or 4 externally facing surfaces.

In order to maintain the triangular side panels in either the first or second configuration relative to the base, the apex of each triangular side panel has an invertible connecting means by which each apex can be connected to one or more of the apexes of the other triangular side panel. Thus, interconnection of the apex corners of the side panels holds the side panels in a substantially upright position relative to the base, creating an essentially fixed pyramid-like tetrahedron. The apex corners interconnection means is preferably but not necessarily in the form of rings, each passing through a respective apex of each side panel, said rings then being interconnected by snap hook means.

In a third assembly arrangement, convenient for storage and transport, the side panels are folded down essentially parallel to the base member, providing a compact assembly configuration of an area no larger than the largest piece, and a height not substantially greater than the sum of the thicknesses of the base member plus the thicknesses of the three side panels. In order for this configuration to be attained, it is necessary that the articular joinder means attaching the side triangular panels to the base have sufficient size or "play" to allow the side panels to fold over as much as the combined thicknesses of the base and two side panels.

The length of the base of each of three isosceles triangular side panels is slightly less than the length of the sides of the equilateral base member. In order for the apexes of the triangular side panels to meet satisfactorily in the middle over the base when in the first or second assembly arrangements, it is preferable that all of the side triangular panels have the same dimensions, and it is necessary that the height of the side panels from the apex to the base be substantially greater than one-half of the altitude of the equilateral base member. It is desirable, but not necessary, that the height from the apex to the base of the side panels not exceed the length of the altitude of the base member. This is so that when the sign display system is in the third assembly arrangement, the side panels do not extend beyond the perimeter of the base piece.

It is also preferable that the articular coupling means by which the side panels are joined to the base piece comprise large openable snap rings. Use of snap rings as the joinder means allows the ready interchangeability of side display panels.

DESCRIPTION OF THE PREFERRED EMBODIMENT

Figure 1:
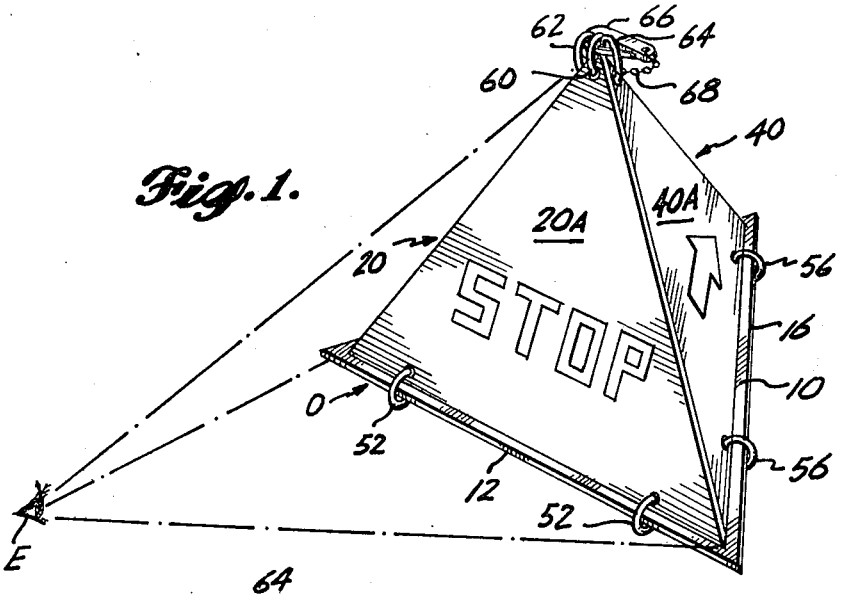
FIG. 1 is an isometric view taken from an upper, frontal aspect of the sign system in an erected position partially showing the rotation of the side pieces relative to the base.
Figure 2:
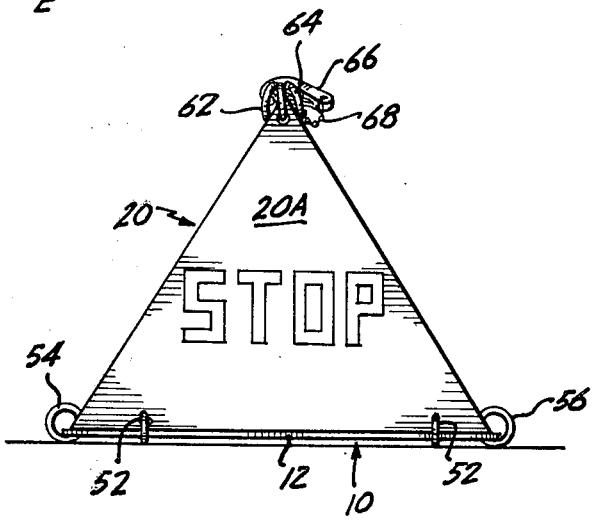
FIG. 2 is a frontal elevational view of the sign system in an erected position.

FIGS. 1 and 2 are respective isometric and plan views of the preferred form of display sign assembly according to the invention, showing a typical arrangement thereof in use as a temporary vehicular traffic control device, with one selected panel, the panel displaying the word "STOP", in the direct view of oncoming traffic. A viewer, schematically depicted by the eye E in FIG. 1, sees the device essentially as it appears in FIG. 2, i.e. sees only one panel and its display, with the other side panels and their displays concealed from view by virtue of the triangular nature of the side panel array.

Figure 5:
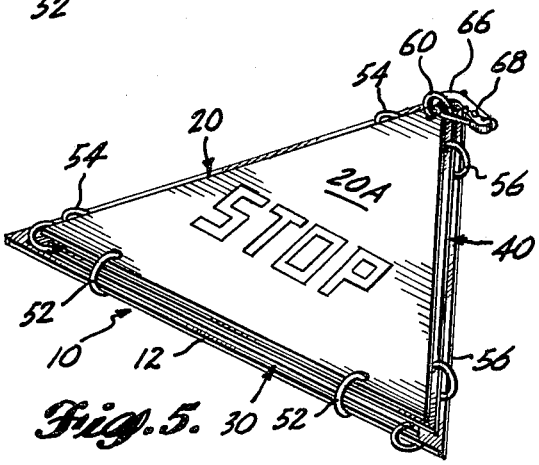
FIG. 5 is an isometric view taken from an upper, frontal aspect illustrating the sign system in a folded, stacked configuration for ease of storage and transport.
Figure 3:
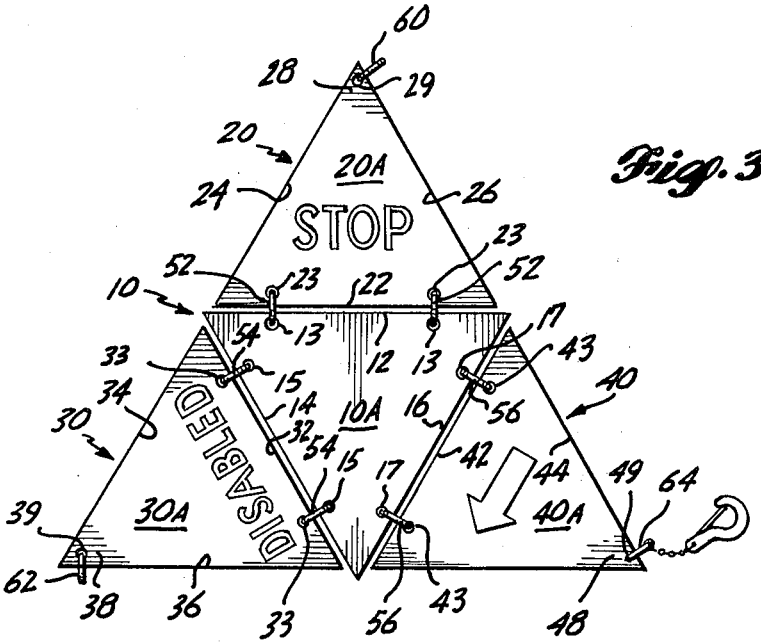
FIGS. 3 and 4 are plan views of the sign system with side panels rotated into the same plane as the base member, specifically illustrating the various faces of the sides and base.
Figure 4:
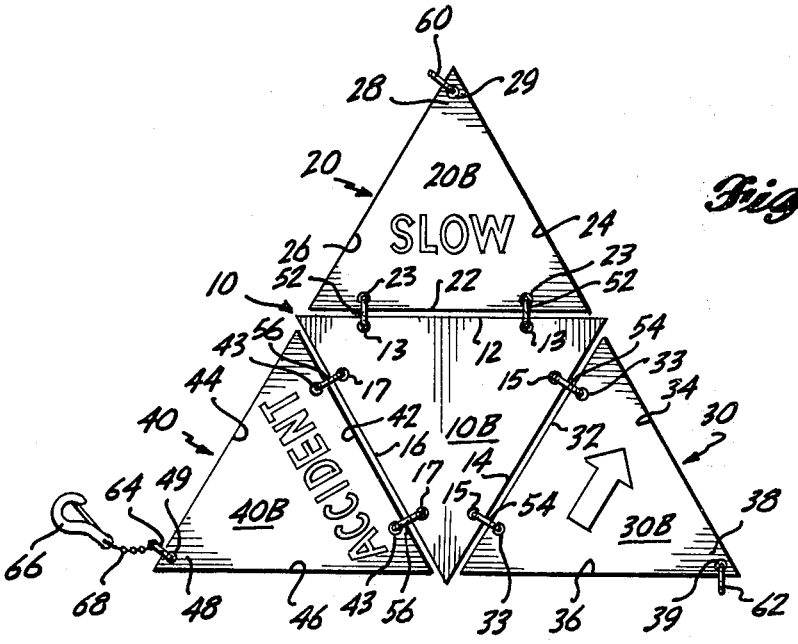

FIGS. 3 and 4 show the display sign assembly of FIGS. 1 and 2 in folded out arrangement to more clearly show the constructional detail thereof. Base member 10, suitably fabricated of sheet metal, is in the shape of a substantially equilateral triangle, with faces 10A and 10B, and with three sides 12, 14, 16 all essentially the same length. Side panels 20, 30 and 40, also suitably fabricated of sheet metal, are all essentially of isosceles triangle shape, and all with essentially the same dimensions, which permits their interchangeability and replacement with any desired side panel from an inventory of other side panels of like construction but bearing different symbols or messages. Each panel has respective faces 20A, 20B and 30A, 30B, and 40A, 40B, each printed or otherwise bearing a different message or symbol, as shown. To permit the side panels to stack flat on the base member in any order when the assembly is collapsed for transport or storage (as shown in FIG. 5), the respective base sides 22, 32, 42 of the side panels 20, 30, 40 are slightly shorter than the respective adjacent sides 12, 14, 16 of the base member 10, and the respective other sides 24, 26, 34, 36, and 44, 46 which join at the respective apex corners 28, 38, 48 of the side panels are slightly shorter than the respective panel base sides 22, 32, 42. For traffic control applications, typical dimensions of the base member and side panels are with the base member sides 12, 14, 16 some twenty-eight inches in length, with side panel base sides 22, 32, 42 some twenty-six inches in length, and with side panel sides 24, 26, 34, 36, 44, 46 some twenty-four inches in length.

In the display sign assembly shown, the side panels 20, 30, 40 are articularly joined to respective sides 12, 14, 16 of the base member 10 by respective pairs of snap rings 52, 54, 56, of a relatively large size, suitably about one and one-half inches in diameter, which pass through opposed pairs of holes along the sides of the base member 10 and the base sides of the adjacent side panels. As shown, rings 52 pass through respective holes 13 in the base member 10 and holes 23 in the side panel 20, rings 54 pass through respective holes 15 in the base member 10 and holes 33 in the side panel 30, and rings 56 pass through holes 17 in the base member 10 and holes 43 in the side panel 40. Use of relatively large snap rings as the means for articularly coupling the side panels to the base member enables ready interchangeability and substitution of any given side panel for any other side panel to provide greater flexibility as to the symbols or messages displayed by the panels and, as earlier indicated, the size of the rings permits the side panels to all stack in a parallel manner (FIG. 5). Such coupling means between the base member and side panels also permit substantially 360° articulation of the side panels relative to the base member so that the side panels may be assembled for use either as shown in FIGS. 1 and 2 with the faces 20A, 30A, 40A outwardly and base member face 10A downwardly, or in inverse arrangement with the panel faces 20B, 30B, 40B outwardly and base member face 10B downwardly, and also in stacked fashion as shown in FIG. 5 or in an inverse arrangement of base member and panels, or for that matter with one or two panels on both sides of the base member.

To permit relatively fixed interconnection of the side panels during use of the display sign assembly of the invention as shown in FIGS. 1 and 2, panel apex corner interconnection means in the form of respective snap rings 60, 62 and 64 are arranged in respective holes 29, 39, 49 in the apex corners 28, 38, 48 of the side panels 20, 30, 40, and a snap hook 66 on a short length of bead chain 68 is attached to one of the rings, ring 64 being selected by way of example. As assembled for use (FIGS. 1 and 2) with the respective apex corners 28, 38, 48 brought together, the snap hook 66 is passed through the rings 60, 62, 64 and restrains the side panels from separation, rendering the assembly of essentially fixed form and stable even in a strong wind. As will be readily understood, the stability thereof may be further ensured by placement of a weight such as a large rock on the base member 10 in the course of arranging the assembly for use.

As will be recognized, various modifications and other adaptations of the assembly are possible. Simply by way of further example, some or all of the display surfaces can bear like symbols or messages rather than different symbols or messages. Symbol or message displays can also be provided on one or both surfaces of the base member 10. As will also be apparent, the base member and side panels may be fabricated of any suitable material other than sheet metal, such as molded plastic, pressed fiberboard, or wood. Applications of the assembly for uses other than traffic control will also be readily apparent, such as use for advertising displays and the like.

What is claimed is:

1. A message display assembly for traffic control or the like, comprising three separable, triangularly shaped panels, each having large message displays on both sides thereof, readily separable panel apex joining means interconnecting the apexes of said panels, readily separable panel side joining means connecting the respective sides of said panels opposite the apexes thereof to the respective sides of a triangularly shaped base member, the readily separable panel apex joining means interconnecting the apexes of said panels and the readily separable panel side joining means connecting said panels and said base member providing, of themselves, in conjunction with said panels and base member, a stable tetrahedronal assembly for display of the messages on one side or the other of said panels with the joining means at the apexes of the panels intereconnected, and providing for ready reversibility of the panels to display the messages on the other sides of said panels by disconnection of the panel apex joining means at one side of said base member and reconnection thereof at the other side of said base member, the said readily separable joining means further enabling ready interchangeability and substitution of other message display panels for any given message display panel.

2. The assembly of claim 1, wherein said readily separable joining means comprise snap rings arranged in holes in said panels and base member.

3. A display sign assembly comprising:

a triangular base member of substantially equilateral form;

three movable and interchangeable triangular side panels of substantially isosceles form, each having a single display message occupying a major portion of each face thereof and each being articulately mounted along its base side to a respective side of said base member by readily separable side panel joining means enabling substantially 360° movement of each side panel relative to the base member so that said side panels may be folded parallel to the base member on either face thereof for storage of the assembly and so that the panels are arrangeable with respective apex corners thereof remote from the base together to form a pyrimid-like tetrahedron over either face of said base member, said readily separable side panel joining means also enabling the side panels to be readily removed and interchanged with respect to said base member;

readily separable apex joining means connecting the respective apex corners of the side panels together enabling the apex corners of the panels to be readily disconnected with respect to each other to facilitate folding the side panels to positions substantially parallel to the base member.

4. A display sign assembly according to claim 3, wherein said base member and side panels are fabricated of relatively thin sheet stock and said readily separable side panel joining means are relatively large snap rings enabling ready removal and interchange of side panels in the assembly and of a size to permit the side panels to stack parallel to the base member.

5. A display sign assembly according to claim 3, wherein said readily separable apex joining means comprises ring means connected to each apex corner respectively and held together by snap hook means.

6. A display sign assembly according to claim 3, wherein the message displays on the faces of the side panels are of a vehicular traffic warning or traffic directing type.

7. A display sign assembly according to claim 3, wherein the base member sides are slightly longer then the base sides of the side panels and the side panel sides joined at the apex corners thereof are slightly shorter than the base sides thereof.

* * * * *